US010525577B2

(12) United States Patent
Masatoshi et al.

(10) Patent No.: US 10,525,577 B2
(45) Date of Patent: Jan. 7, 2020

(54) POWER TOOL

(71) Applicant: Nanjing Chervon Industry Co., Ltd., Nanjing (CN)

(72) Inventors: Fukinuki Masatoshi, Nanjing (CN); Jingdong Hao, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 246 days.

(21) Appl. No.: 15/817,517

(22) Filed: Nov. 20, 2017

(65) Prior Publication Data

US 2018/0147709 A1 May 31, 2018

(30) Foreign Application Priority Data

Nov. 25, 2016 (CN) ..... 2016 1 1062456

(51) Int. Cl.
*B25D 9/04* (2006.01)
*B25D 9/08* (2006.01)

(52) U.S. Cl.
CPC ..... *B25D 9/04* (2013.01); *B25D 9/08* (2013.01); *B25D 2250/301* (2013.01)

(58) Field of Classification Search
CPC ..... B25D 9/04; B25D 9/08; B25D 2250/301
USPC ..... 173/200
See application file for complete search history.

(56) References Cited

U.S. PATENT DOCUMENTS 3,568,780 A * 3/1971 Matsuo ..... B25D 11/125 173/201
3,878,902 A * 4/1975 Matsuo ..... B25D 11/125 173/14
8,875,969 B2 * 11/2014 Pedicini ..... B25C 1/04 227/10
10,286,534 B2 * 5/2019 Kato ..... B25C 1/06

* cited by examiner

*Primary Examiner* — Michelle Lopez
(74) *Attorney, Agent, or Firm* — Greenberg Traurig, LLP

(57) ABSTRACT

A power tool includes a housing, a prime mover disposed in the housing, a first cylinder formed with a first chamber, a first rotating member rotatable with respect to the first cylinder about a first axis under the driving of the prime mover, a first piston movable in a direction parallel to the first axis when the first rotating member rotates relative to the first cylinder. The first cylinder and the first rotating member are disposed within the housing. The first piston is disposed within the first chamber The first rotating member is formed with a first transmission structure to drive the first piston The first piston is formed with a second transmission structure capable of cooperating with the first transmission structure to rotate the first rotation member to drive the first piston.

10 Claims, 10 Drawing Sheets

POWER TOOL

RELATED APPLICATION INFORMATION

This application claims the benefit under 35 U.S.C. § 119(a) of Chinese Patent Application No. CN 201611062456.6, filed on Nov. 25, 2016, the disclosure of which is incorporated herein by reference in its entirety.

FIELD OF THE DISCLOSURE

The present disclosure relates to power tools, and more particularly to a power tool for impacting fasteners.

BACKGROUND OF THE DISCLOSURE

Nail guns are a kind of power tool which can produce an impact to hit a nail with a striking pin.

The nail gun usually includes a housing, a cylinder, a piston, a striking pin, a prime mover and an impact mechanism. The piston is disposed in the cylinder. The striking pin is connected with the piston. The prime mover drives the impact mechanism and then impacts the piston to move in the cylinder. However, the existing impact mechanism occupies a large space in the housing, and the effective stroke of the piston also usually depends on the size of the impact mechanism. Thus, it is not conducive to miniaturization of the nail gun and the strike is relatively poor.

The statements in this section merely provide background information related to the present disclosure and may not constitute prior art.

SUMMARY

In one aspect of the disclosure, a power tool is provided. The power tool includes a housing, a prime mover disposed in the housing, a first cylinder formed with a first chamber, a first rotating member rotatable with respect to the first cylinder about a first axis under the driving of the prime mover, a first piston movable in a direction parallel to the first axis when the first rotating member rotates relative to the first cylinder. The first cylinder and the first rotating member are disposed within the housing. The first piston is disposed within the first chamber. The first rotating member is formed with a first transmission structure to drive the first piston. The first piston is formed with a second transmission structure capable of cooperating with the first transmission structure to rotate the first rotation member to drive the first piston.

Further areas of applicability will become apparent from the description provided herein. It should be understood that the description and specific examples are intended for purposes of illustration only and are not intended to limit the scope of the present disclosure.

Figure 1:
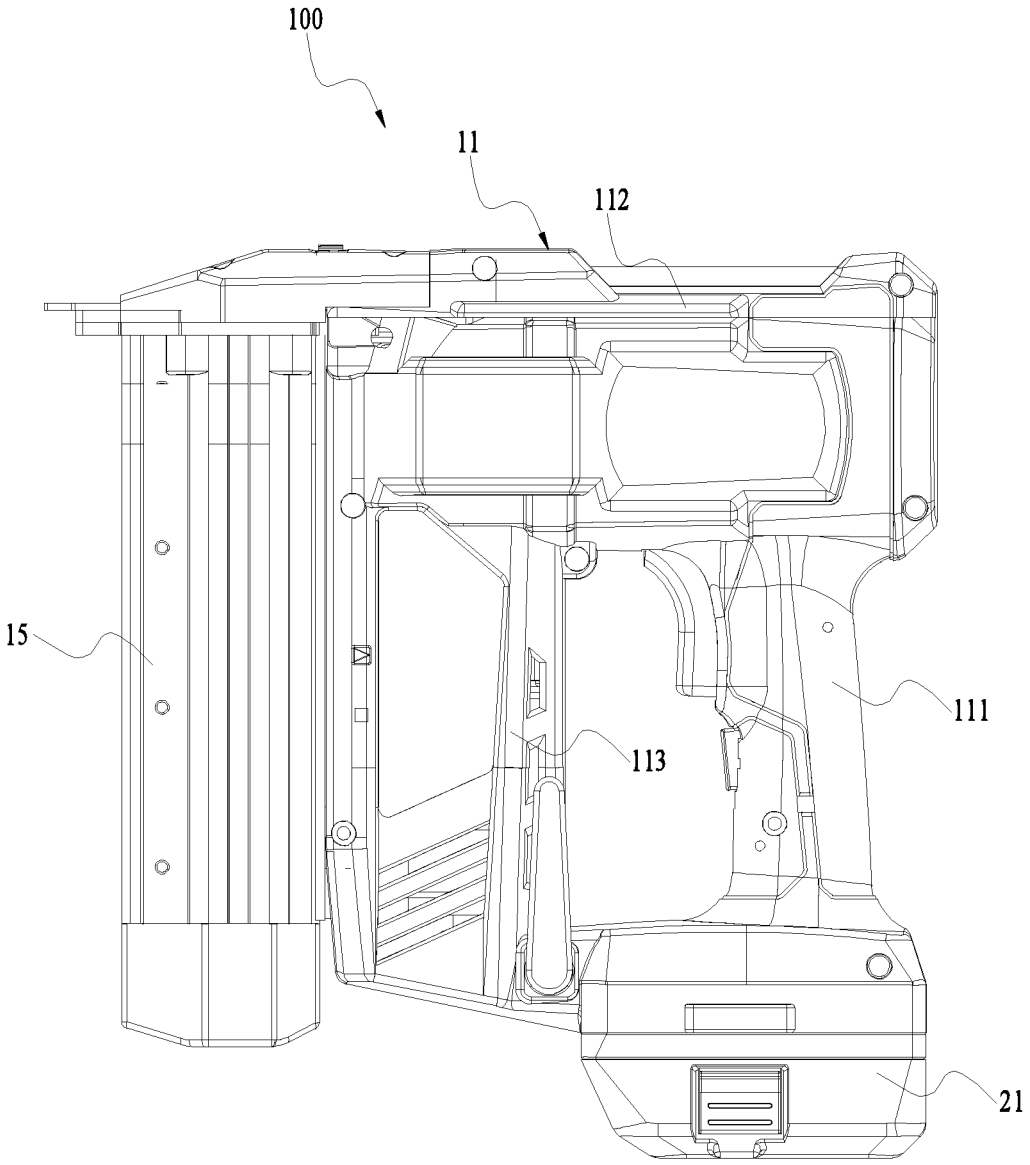
FIG. 1 is a schematic structural view of an exemplary power tool.
Figure 2:
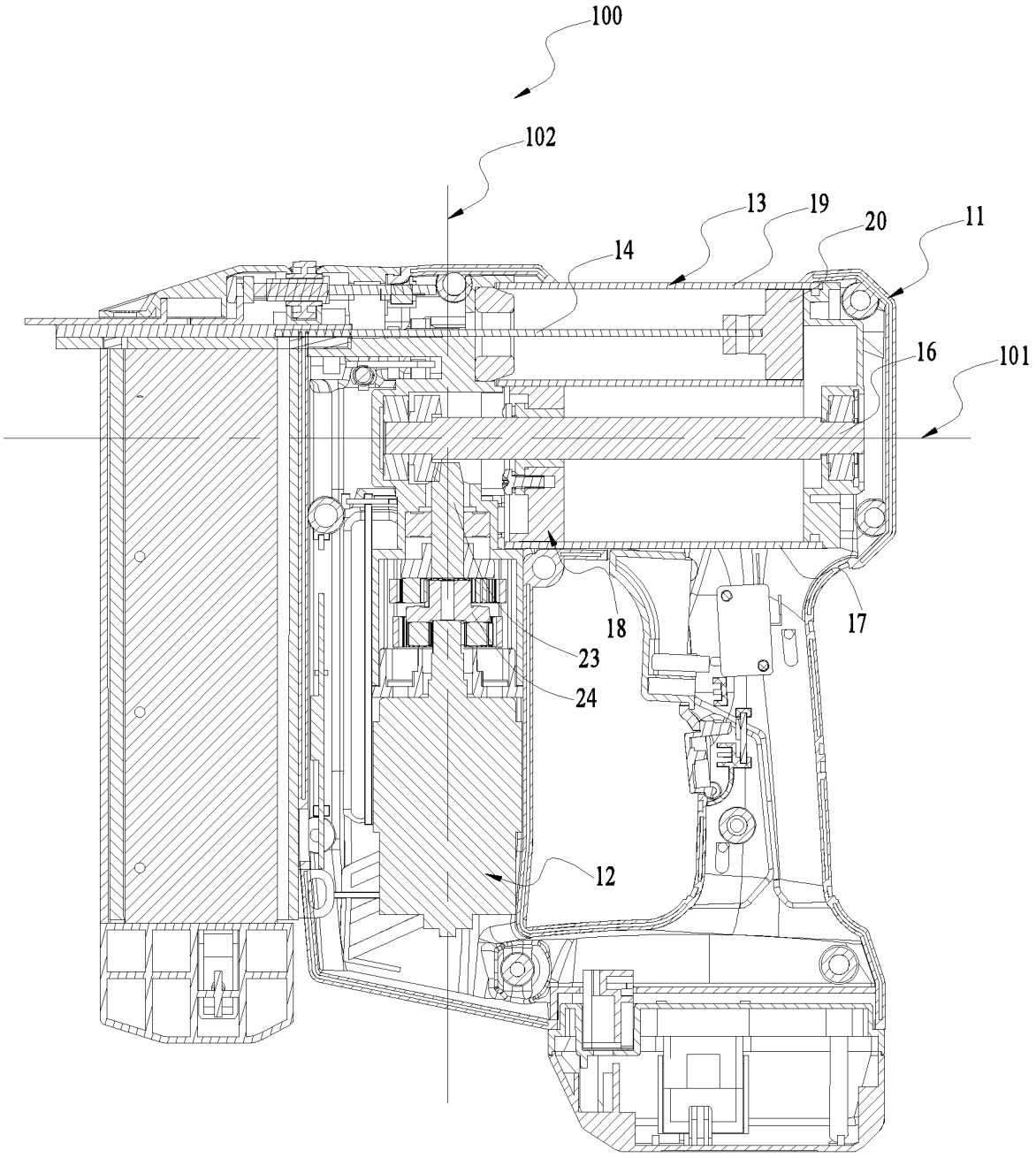
FIG. 2 is a cross-sectional view of the power tool of FIG. 1.
Figure 3:
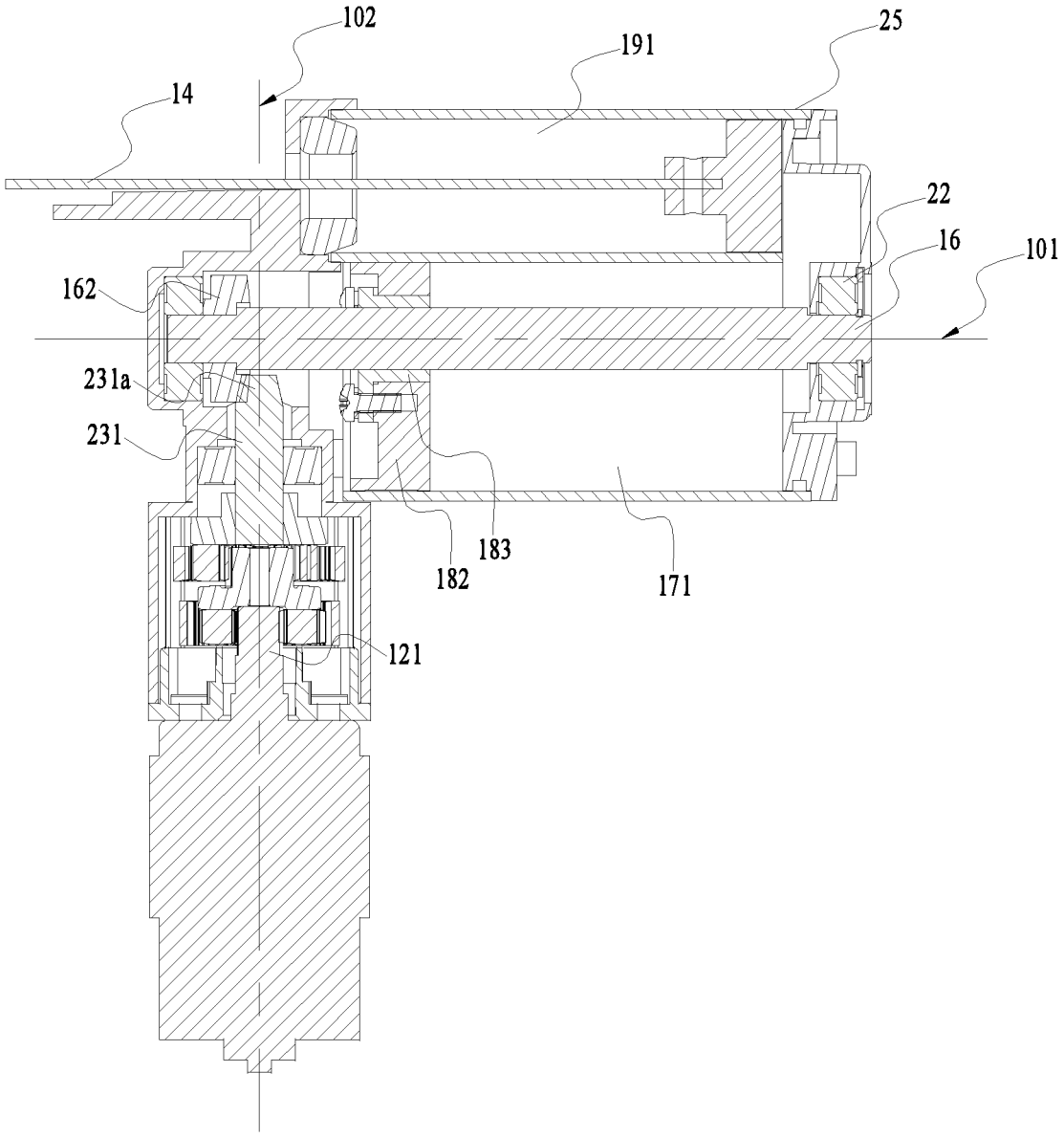
FIG. 3 is a cross-sectional view of the prime mover, decelerating mechanism, reversing mechanism and impact mechanism of FIG. 2.
Figure 4:
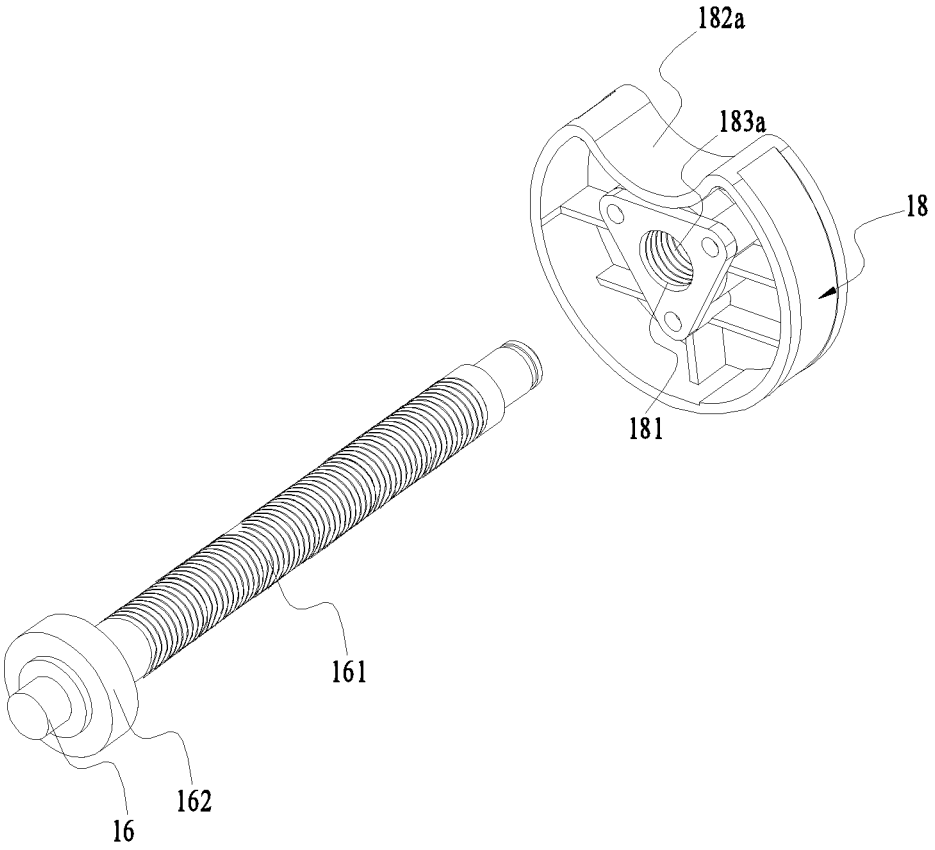
FIG. 4 is a schematic structural view of the first rotating member and the first piston in FIG. 3.

The drawings described herein are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

The following description of the preferred embodiments is merely exemplary in nature and is in no way intended to limit the invention claimed, its application, or uses.

As shown in FIG. 1, a power tool may specifically be a nail gun 100 for generating an impact force on a nail, so as to impact the nail into a workpiece. In fact, the power tool may also be other tools that can use the principles described hereinafter.

Referring to FIGS. 1-4, the nail gun 100 includes a housing 11, a prime mover 12, an impact mechanism 13, a striking pin 14, and a magazine 15. The impact mechanism 13 may include a first rotating member 16, a first cylinder 17, a first piston 18, a second cylinder 19 and a second piston 20. The striking pin 14 is used for outputting an impact force to the nail. The magazine 15 is used for accommodating nails.

The housing 11 is formed with an inner space for accommodating the prime mover 12 and the impact mechanism 13, and the outer portion of the housing 11 is connected to a magazine 15 for placing nails. The first cylinder 17 is formed with a first chamber 171, the first piston 18 is disposed in the first chamber 171, the second cylinder 19 is formed with a second chamber 191, the second piston 20 is disposed in the second chamber 191, wherein the first chamber 171 and the second chamber 191 are also in communication with each other. The striking pin 14 and the second piston 20 form a fixed connection. The first rotating member 16 can rotate relative to the first cylinder 17 about the first axis 101 under the driving of the prime mover 12 and the first rotating member 16 can be fixed relative to the axial position of the first cylinder 17. The first rotating member 16 is further formed with a first transmission structure 161 capable of driving the first piston 18 to move relative to the first cylinder 17 in a direction parallel to the first axis 101 when the first rotating member 16 rotates, the first piston 18 is formed with a second transmission structure 181 capable of cooperating with the first transmission structure 161 for rotating the first rotating member 16 to drive the first piston 18, and the second piston 20 is movably disposed in the second chamber 191 along a direction parallel to the first axis 101.

In this way, when the prime mover 12 is started, the first rotating member 16 rotates along the first axis 101 under the driving of the prime mover 12, and the rotating first rotating member 16 in turn drives the first piston 18 to move within the first chamber 171 to compress the gas in the first chamber 171, the compressed gas in the first chamber 171 in turn drives the second piston 20 in the second chamber 191, so that the second piston 20 drives the striking pin 14 to impact the nail. Wherein the first rotating member 16 is rotatably disposed in the housing 11 and capable of driving the first piston 18 to move when it is rotated without moving along the first axis 101 along with the first piston 18 so as to be able to reduce the size of the impact mechanism 13 in the direction along the first axis 101, then further to reduce the size of the nail gun 100 in the direction of the first axis 101 and facilitate the miniaturization of the power tool; moreover, the effective stroke when the first piston 18 moves does not depend on the length of the first rotating member 16 in the direction of the first axis 101.

Specifically, the housing 11 is formed with a handle portion 111, a first accommodating portion 112 for accommodating the impact mechanism 13, and a second accommodating portion 113 for accommodating the prime mover 12. The handle portion 111 and the second accommodating portion 113 are respectively disposed at two ends of the first accommodating portion 112 in the direction of the first axis 101, and the handle portion 111 and the second receiving portion 113 extend on both ends of the first accommodating portion 112 in a direction perpendicular to the first axis 101.

The prime mover 12 includes a prime mover shaft 121 rotatable about the second axis 102 perpendicular to the first axis 101 and the prime mover 12 is disposed in the second accommodating portion 113 of the housing 11 approximately along the second axis 102. In this example, the prime mover 12 can be a motor, and the prime mover shaft 121 can be a motor shaft, and the motor shaft extends along the second axis 102. For the motor, the nail gun 100 may further include a battery pack 21 for supplying electric power to the motor, and the battery pack 21 is detachably coupled to the handle portion 111 of the housing 11.

In this example, the first rotating member 16 extends into the first cylinder 17 such that the first rotating member 16 is partially disposed in the first chamber 171. The first piston 18 includes a piston portion 182 and a transmission portion 183, and the transmission portion 183 and the piston portion 182 form a fixed connection. Certainly, it can be understood that the transmission portion 183 and the piston portion 182 may also be integrally formed. It should be noted that those skilled in the art may understand that a portion that is fixedly connected to the piston portion 182 and moves with respect to the first cylinder 17 along with the piston portion 182 in the direction along the first axis 101 may be regarded as a part of the first piston 18. The transmission portion 183 of the first piston 18 is formed with a transmission hole 183*a*, and the first rotation member 16 is at least partially located in the transmission hole 183*a*. In this example, the transmission hole 183*a* penetrates the first piston 18, and the first rotation member 16 passes through the transmission hole 183*a*. The first transmission structure 161 is an external thread formed on the outer periphery of the first rotating member 16, the second transmission structure 181 is an internal thread formed on the hole wall of the transmission hole 183*a*, and the internal thread and the external thread match with each other. In addition, the first piston 18 is fixed in the circumferential position inside the first chamber 171, that is to say the circumferential rotation of the first piston 18 is limited. In this way, when the first rotating member 16 is driven by the prime mover 12 to rotate about the first axis 101 relative to the first cylinder 17, the first piston 18 cannot rotate circumferentially. Therefore, under the matching of the external thread and the internal thread, the first piston 18 will move on the first rotating member 16 in the direction of the first axis 101.

Both ends of the first rotating member 16 are respectively disposed outside the first cylinder 17 in the direction of the first axis 101. A bearing 22 respectively mounted on both ends of the first rotating member 16 is also provided in the housing 11 and the bearing 22 supports the first rotating member 16.

As described above, the second axis 102 when the prime mover shaft 121 rotates is perpendicular to the first axis 101 when the first rotating member 16 rotates. Therefore, in order to realize the driving of the first rotating member 16 by the prime mover 12, a reversing mechanism 23 for reversing between the prime mover 12 and the first rotating member 16 and a decelerating mechanism 24 for slowing down are also provided in the housing 11, further, the decelerating mechanism 24 is provided between the prime mover 12 and the reversing mechanism 23. The decelerating mechanism 24 may include a multiply planetary gear train, and the reversing mechanism 23 includes a first shaft 231, which may serve as an output shaft of the decelerating mechanism 24. The first shaft 231 can rotate about the second axis 102 under the driving of the prime mover 12, and a first bevel gear 231*a* is formed at or connected to one end of the first shaft 231 away from the prime mover 12, correspondingly, a second bevel gear 162 capable of matching with the first bevel gear 231*a* is formed at or connected to one end of the first rotating member 16 close to the prime mover 12. Due to the matching between the first bevel gear 231*a* and the second bevel gear 162, a reversing between the prime mover shaft 121 and the first rotor 16 can be achieved. In this way, the reversing mechanism 23 brings about the reversing between the prime mover 12 and the first rotating member 16, and the matching between the first rotating member 16 and the first piston 18 enables the movement of the first piston 18, so that the structures of various parts of the housing 11 are compact, thereby reducing the size of the whole machine.

Figure 5:
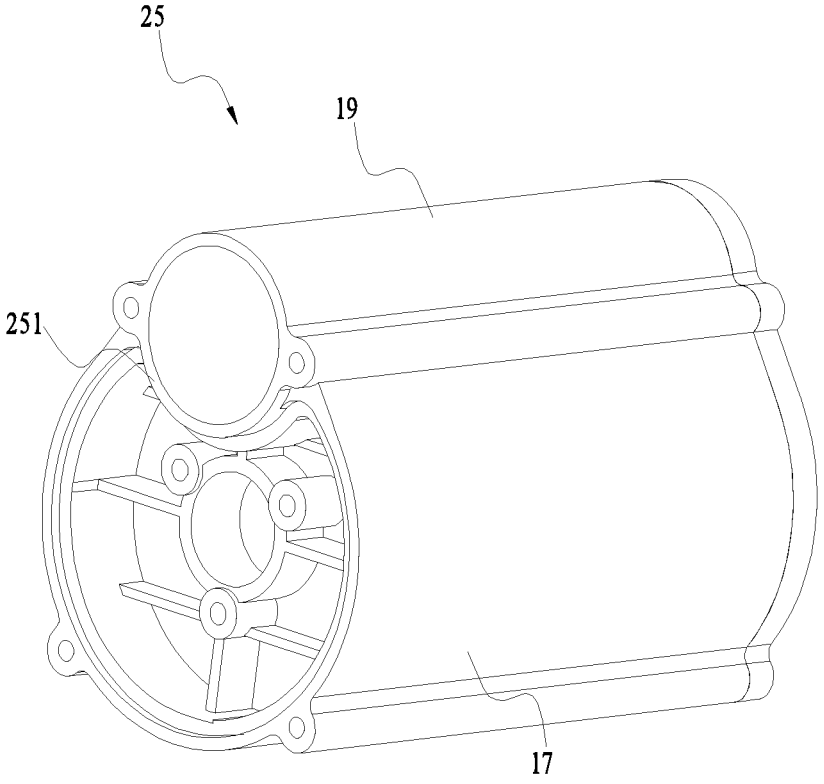
FIG. 5 is a schematic structural view of the cylinder housing in FIG. 3.
Figure 6:
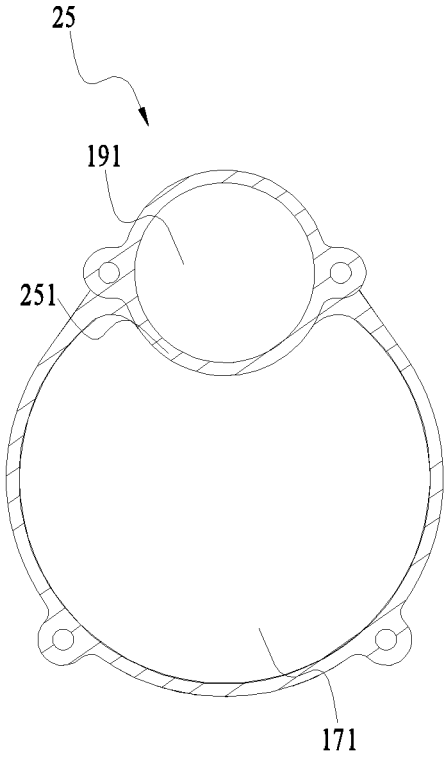
FIG. 6 is a cross-sectional view of the cylinder housing of FIG. 5.

Referring to FIGS. 2-6, a cylinder housing 25 for forming the first cylinder 17 and the second cylinder 19 is also provided in the housing 11. A partition 251 is formed in the cylinder housing 25, and the partition 251 partitions the internal space of the cylinder housing 25 into a first chamber 171 to form the first cylinder 17 and a second chamber 191 to form the second cylinder 19. The first cylinder 17 and the second cylinder 19 each extend in a direction parallel to the first axis 101, and the partition 251 further protrudes toward the first cylinder 17 in a direction perpendicular to the first axis 101. In this way, it is possible to partially overlap the first cylinder 17 and the second cylinder 19 in a plane perpendicular to the first axis 101, and the overlapped portion protrudes toward the first cylinder 17. As shown in FIG. 5, the cross sections of the first chamber 171 and the second chamber 191 in a plane perpendicular to the first axis 101 are two intersecting circles, and the intersecting portion belongs to the second chamber 191, and the radius of the circle corresponding to the second chamber 191 is smaller than the radius of the circle corresponding to the first chamber 171. In this way, on the one hand, the effective stroke of the first piston 18 can be increased to increase the effective utilization of the cylinder housing 25; on the other hand, the space occupied by the cylinder housing 25 can be reduced. In addition, the structure of the first piston 18 is also the same as the cross-section structure of the first chamber 171 in order to match the irregular structure of the first chamber 171. That is, the first piston 18 is formed with a notch 182*a* for enabling the partition 251 to be fitted. In this way, the first piston 18 in the first chamber 171 will be restricted from rotating circumferentially due to the limit of the portion where the second cylinder 19 and the first cylinder 17 overlap, and further, when the first rotating member 16 rotates, the first piston 18 is driven by the rotating first rotating member 16 to move in the direction of the first axis 101 because the rotation of the first piston 18 relative to the first cylinder 17 is limited.

Figure 7:
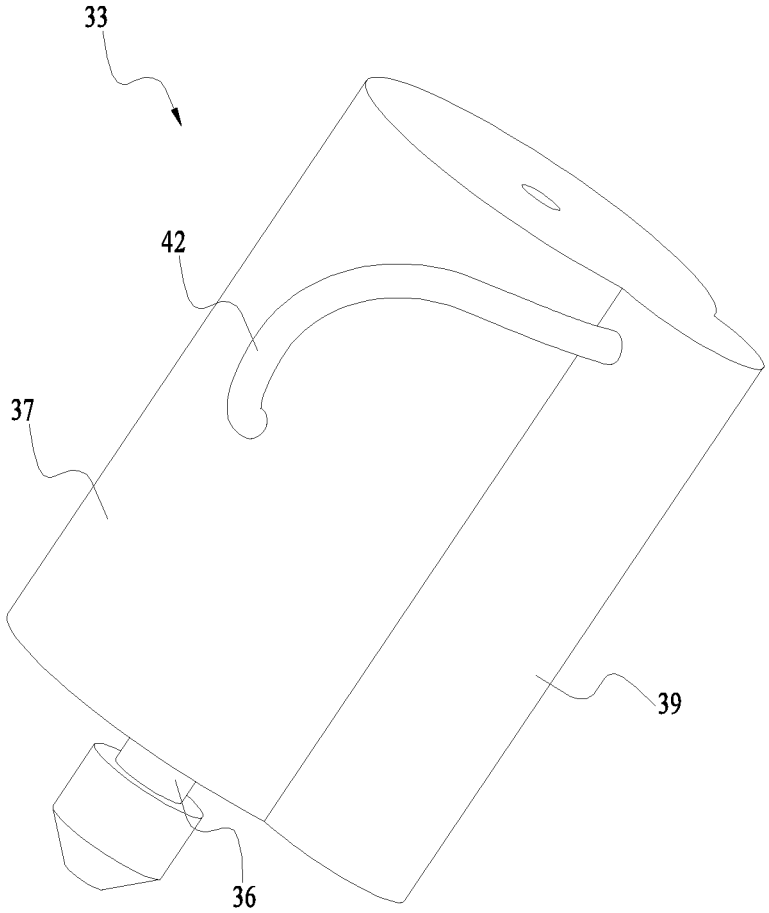
FIG. 7 is a schematic structural view of an impact mechanism in an exemplary power tool.
Figure 8:
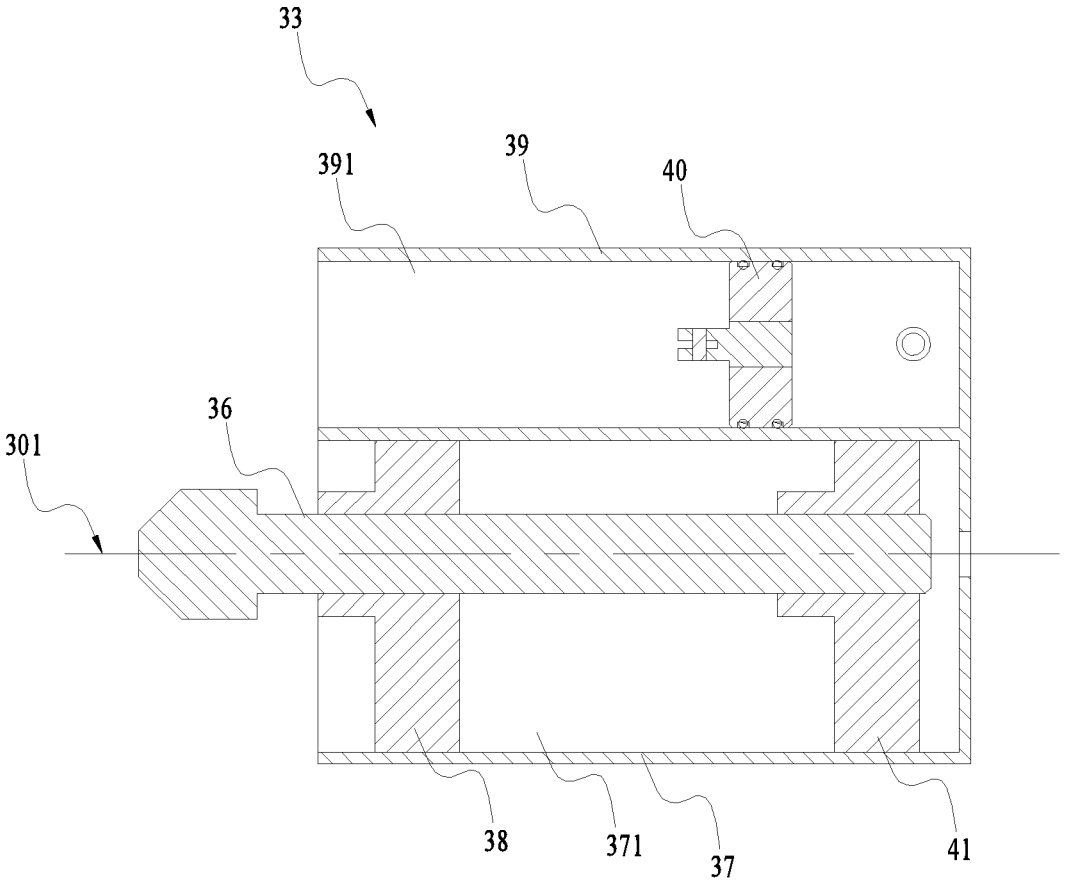
FIG. 8 is a cross-sectional view of the structure shown in FIG. 7.

Also contemplated is a nail gun which may have the same housing, prime mover, striking pin and magazine as described previously, as shown in FIGS. 7 and 8, with the only difference residing in the impact mechanism 33. In this example, there may be a part that is compatible with the previously described example, and is not specifically described again, and only a part that is different is introduced below. The impact mechanism 33 includes a first cylinder 37, a first piston 38, a second cylinder 39, and a second piston 40 that are the same as previously described, and the impact mechanism 33 further includes a first rotating member 36 and a third piston 41 disposed in the first chamber 371 formed by the first cylinder 37. The first rotating member 36 is driven by the prime mover to rotate about the first axis 301, the first rotating member is provided with a first transmission structure for driving the first piston 38 and a third transmission structure for driving the third piston 41, the first transmission structure and the third transmission structure are respectively two external threads of opposite rotation directions disposed on the outer periphery of the first rotating member 36. Correspondingly, the first piston 38 is formed with a second transmission structure matching with the first transmission structure, the third piston 41 is formed with a fourth transmission structure matching with the third transmission structure, and the second transmission structure and the fourth transmission structure are also internally threads of opposite rotation directions. In this way, when the first rotating member 36 rotates, the third piston 41 can move in a direction opposite to the direction of movement of the first piston 38, so that the first piston 38 and the third piston 41 can move toward or away from each other at the same time, thereby reducing the compression time of the air. In addition, in order to increase the effective stroke of the first piston 38 and the third piston 41, the first chamber 371 formed by the first cylinder 37 and the second chamber 391 formed by the second cylinder 39 may communicate with each other via a pipe 42 disposed outside the cylinder housing 25.

Figure 9:
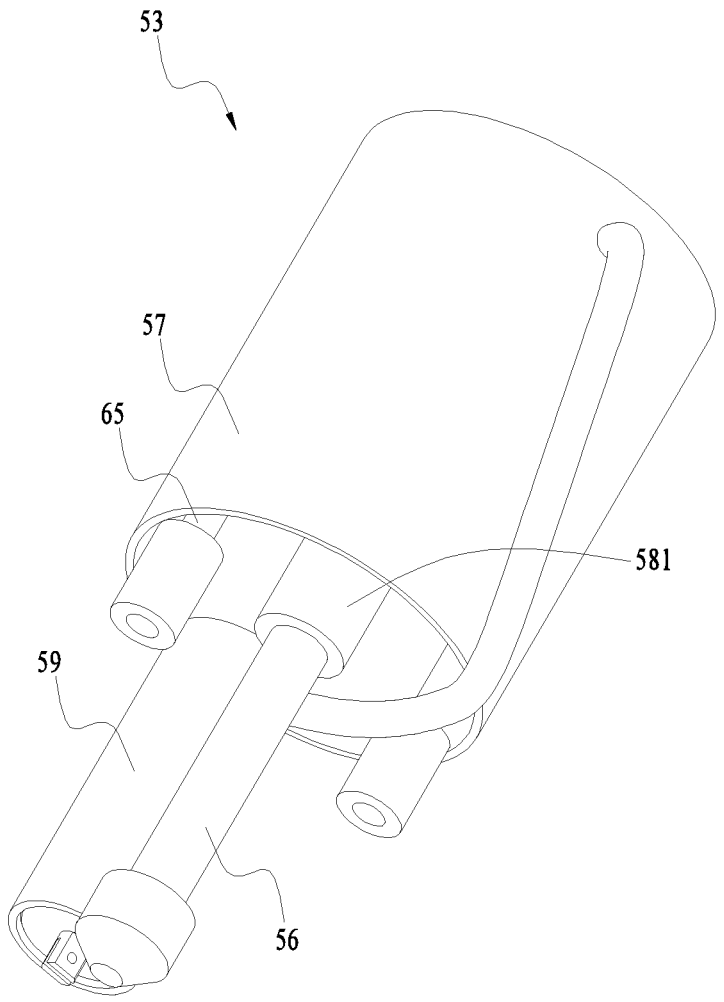
FIG. 9 is a schematic structural view of an impact mechanism in an exemplary power tool.
Figure 10:
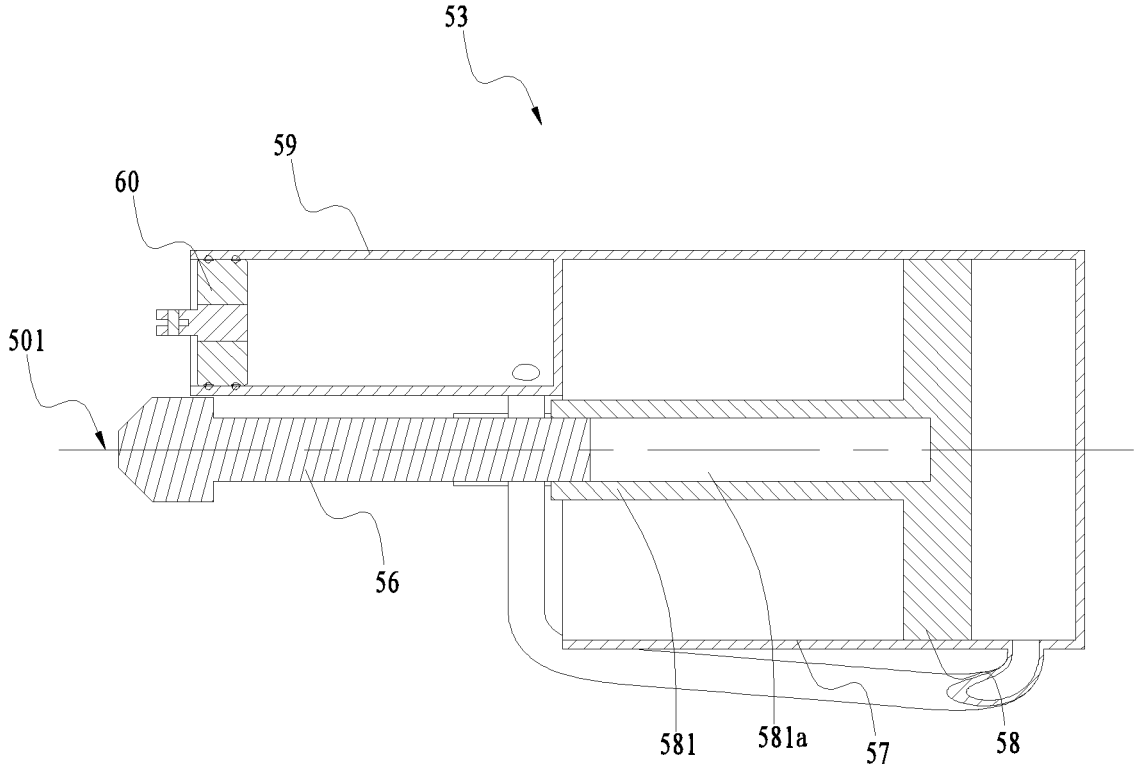
FIG. 10 is a cross-sectional view of the structure shown in FIG. 9.

Also contemplated is a nail gun which again may have the same housing, prime mover, striking pin and magazine as described above, as shown in FIG. 9, with the only difference that the impact mechanism 53 is different. In this example, there may be a part that is compatible with the previously described example, and is not specifically described again, and only a part that is different is introduced below. The impact mechanism 53 includes a first cylinder 57, a first piston 58, a second cylinder 59, a second piston 60, and a first rotating member 56. The first rotating member 56 is driven by a prime mover to rotate about a first axis 501. The first cylinder 57 and the second cylinder 59 are respectively two hollow cylinders, and the first cylinder 57 and the second cylinder 59 are sequentially arranged in a direction parallel to the first axis 501. The first rotating member 56 is located outside the first cylinder 57, and a first transmission structure is formed on the outer periphery of the first rotating member 56. The first piston 58 is formed with a protrusion 581 toward the first rotating member 56, the protrusion 581 extends outside the first cylinder 57, and the protrusion 581 is formed with a transmission hole 581*a*. The first rotation member 56 extends into the transmission hole 581*a*, and the hole wall of the transmission hole 581*a* is formed with a second transmission structure that matches with the first transmission structure. The impact mechanism 53 also includes a stop pin 65 for limiting the circumferential rotation of the first piston 58. In this way, when the first rotating member 56 rotates, the first piston 58 can also be driven to move in the direction of the first axis 501 by the matching of the first transmission structure and the second transmission structure. Wherein the first air cylinder 57 and the second air cylinder 59 are arranged in a direction parallel to the first axis 501, so as to reduce the radial dimension of the entire impact mechanism 53.

The above illustrates and describes basic principles, main features and advantages of the exemplary tools. Those skilled in the art should appreciate that the above examples do not limit the invention claimed hereinafter to any particular form. Technical solutions obtained by equivalent substitution or equivalent variations all intended to fall within the scope of the invention claimed.

What is claimed is:

1. A power tool, comprising:

a housing;

a prime mover disposed in the housing;

a first cylinder formed with a first chamber;

a first rotating member rotatable with respect to the first cylinder about a first axis under a driving force of the prime mover; and a first piston movable in a direction parallel to the first axis when the first rotating member rotates relative to the first cylinder;

wherein the first cylinder and the first rotating member are disposed within the housing, the first piston is disposed within the first chamber, the first rotating member is formed with a first transmission structure to drive the first piston, and the first piston is formed with a second transmission structure capable of cooperating with the first transmission structure to rotate the first rotation member to drive the first piston.

2. The power tool of claim 1, wherein the prime mover comprises a prime mover shaft rotatable about a second axis perpendicular to the first axis and the power tool further comprises a reversing mechanism for reversing between the prime mover shaft and the first rotating member.

3. The power tool of claim 2, wherein the reversing mechanism comprises a first shaft that can be driven by the prime mover to rotate about the second axis, the first shaft is formed with or connected to a first bevel gear, and the first rotation member is formed with or connected to a second bevel gear capable of matching with the first bevel gear.

4. The power tool of claim 3, wherein the first piston is formed with a transmission hole, the first rotary member is at least partially located in the transmission hole, the first transmission structure is an external thread formed on an outer periphery of the first rotating member, and the second transmission structure is an internal thread provided on the hole wall of the transmission hole.

5. The power tool of claim 1, wherein the power tool further comprises:

a striking pin for outputting an impact force;

a second cylinder formed with a second chamber; and a second piston movably disposed in the second chamber along a direction parallel to the first axis and forming a fixed connection with the striking pin;

wherein the second chamber is in communication with the first chamber.

6. The power tool of claim 5, wherein the second cylinder partially overlaps with the first cylinder in a plane substantially perpendicular to the first axis, the portion where the second cylinder and the first cylinder overlap protrudes toward the first cylinder, and the first piston is limited in position by a portion where the second cylinder and the first cylinder overlap so as to be restricted from rotating circumferentially.

7. The power tool of claim 5, wherein the power tool further comprises a cylinder housing comprising a partition capable of partitioning it into the first chamber to form the first cylinder and the second chamber to form the second cylinder and the partition protrudes toward the first cylinder.

8. The power tool of claim 1, wherein the power tool further comprises a third piston that is movable in a direction opposite to a movement direction of the first piston when the first rotating member is rotated with respect to the first cylinder, the third piston is disposed in the first chamber, the first rotating member is further formed with a third transmission structure to drive the third piston, and the third piston is formed with a fourth transmission structure capable of cooperating with the third transmission structure to rotate the first rotating member to drive the third piston.

9. The power tool of claim 1, wherein the power tool further comprises a decelerating mechanism disposed between the prime mover and the first rotating member.

10. The power tool of claim 1, wherein the first rotating member is fixed relative to the axial position of the first cylinder.

* * * * *